United States Patent [19]

Peruzzi

[11] Patent Number: 4,793,775

[45] Date of Patent: Dec. 27, 1988

[54] HERMETIC MOTOR-COMPRESSOR UNIT FOR REFRIGERATION CIRCUITS

[75] Inventor: Federigo Peruzzi, Turin, Italy

[73] Assignee: ASPERA S.R.l., Turin, Italy

[21] Appl. No.: 158,119

[22] Filed: Feb. 16, 1988

Related U.S. Application Data

[63] Continuation of Ser. No. 893,554, filed as PCT EP85/00545 on Oct. 17, 1985, published as WO86/02703 on May 9, 1986, abandoned.

[30] Foreign Application Priority Data

Oct. 13, 1984 [IT] Italy ..... 68088 A/84

[51] Int. Cl.[4] ..... F04B 21/00; F04B 17/00

[52] U.S. Cl. ..... 417/312; 417/313; 417/360; 417/363; 417/902

[58] Field of Search ..... 417/360, 363, 312, 902, 417/313

[56] References Cited

U.S. PATENT DOCUMENTS

| | | | |
|---|---|---|---|
| 2,133,875 | 10/1938 | Steenstrup . | |
| 3,187,996 | 6/1965 | Ruelsgaard | 417/902 |
| 4,086,032 | 4/1978 | Nishioka et al. | 417/902 |
| 4,531,894 | 7/1985 | Kawai et al. | 417/902 |
| 4,606,706 | 8/1986 | Utter | 417/902 |

FOREIGN PATENT DOCUMENTS

| | | | |
|---|---|---|---|
| 1189565 | 3/1965 | Fed. Rep. of Germany . | |
| 2020151 | 7/1970 | France . | |
| 2370244 | 6/1978 | France . | |
| 2532731 | 3/1984 | France . | |
| 0072210 | 6/1978 | Japan | 417/313 |
| 2097866 | 11/1982 | United Kingdom . | |

*Primary Examiner*—Carlton R. Croyle
*Assistant Examiner*—Timothy S. Thorpe
*Attorney, Agent, or Firm*—Sughrue, Mion, Zinn, Macpeak, and Seas

[57] ABSTRACT

An intake pipe (58) termimates at and is sealed to the outside of the casing of the unit. The outlet of this pipe into the casing is an orifice in the wall (120) of the casing. The intake opening of the motor-compressor is provided with a connector duct in the form of a separator-silencer body (56) which has an inlet aperture (86) facing the outlet orifice (124) of the intake pipe and which carries a suction cup (62) in the form of a cup of material that is resiliently deformable in an axial sense. The bottom of the suction cup (62) communicates with the interior of the intake duct (56) while the edge of the suction cup is pressed into resilient engagement with the inner surface of the wall (120) of the casing around the outlet orifice (124).

1 Claim, 4 Drawing Sheets

Figure 1:
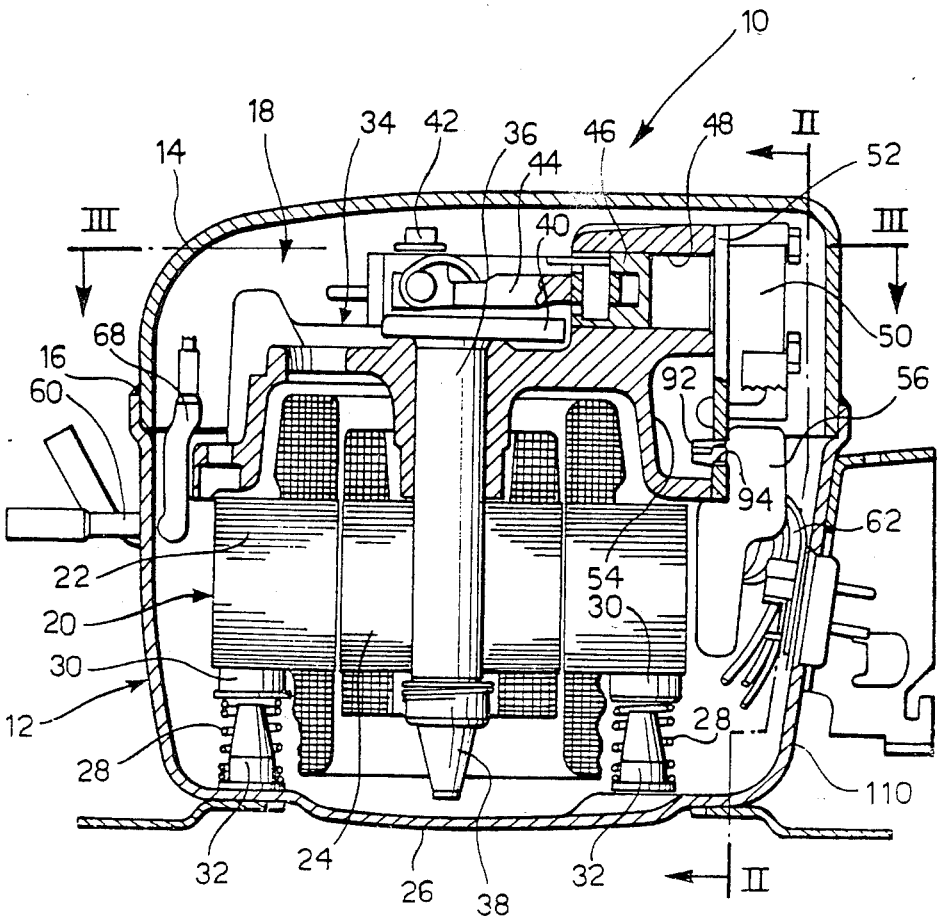

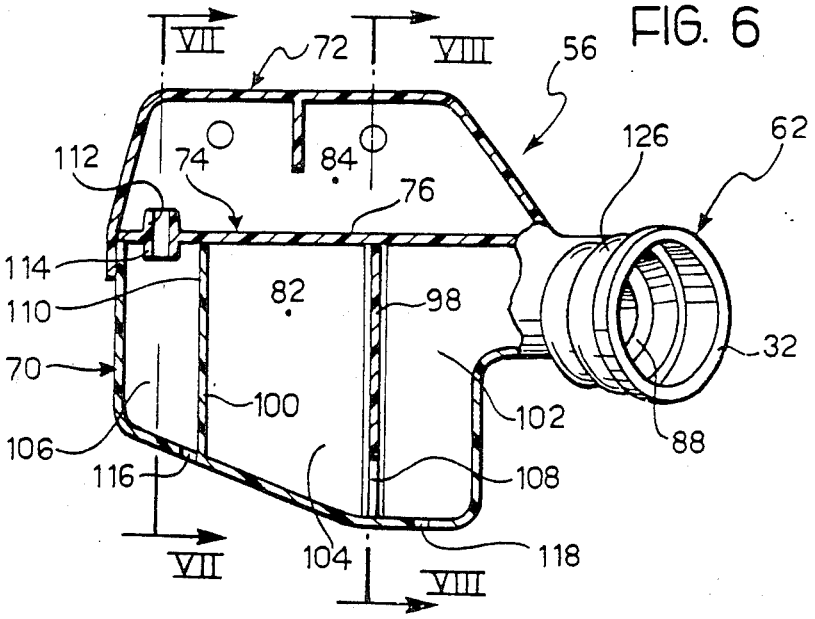
FIG. 6
FIG. 7
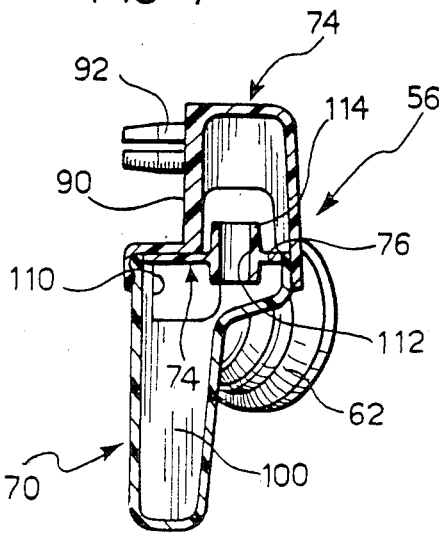
FIG. 8
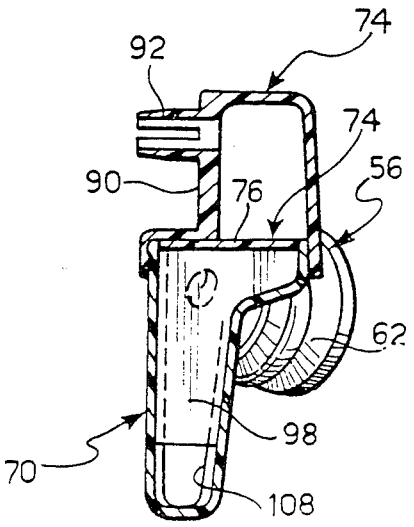

HERMETIC MOTOR-COMPRESSOR UNIT FOR REFRIGERATION CIRCUITS

This is a continuation of application Ser. No. 893,554, filed as PCT EP85/00545 on Oct. 17, 1985, published as WO86/02703 on May 9, 1986, now abandoned.

The present invention relates to a hermetic motor-compressor unit for refrigeration circuits and the like, of the type in which a sealed casing encloses a volumetric motor-compressor for the refrigerant fluid and in which a pair of pipes terminate at the outside of the casing, one of which is a fluid intake pipe opening into the casing through a wall of the latter and communicating with an intake opening of the motor-compressor.

In known units of this type, used in domestic refrigerators, air conditioners and like installations, the intake pipe opens directly into the interior of the casing the internal atmosphere of which is thus constituted by the fluid inducted in the gaseous state. This gas is then drawn through the intake opening of the compressor, possibly via a silencer.

The main disadvantage of such an indirect intake system, which is widely used, is the fact that the gas, before being drawn into the compressor, is in heat-exchange contact with the hot walls of the compressor, with the electric motor thereof, and with the delivery piping thereof, whereby, having a relatively high specific volume, its mass flow rate is relatively low, to the detriment of the efficiency of the refrigeration and the efficiency of the compressor. This of course leads to a rather high consumption of electical energy, which it would be desirable to reduce.

The object of the present invention is to remedy this disadvantage.

According to the present invention, this object is achieved by means of a motor-compressor unit of the type mentioned at the beginning, characterized in that the outlet of the intake pipe into the casing is an orifice in the wall of the casing, and the intake opening of the motor-compressor is provided with a connector duct which has an inlet aperture facing the outlet orifice of the intake pipe and which carries a suction cup in the form of a cup of material that is resiliently deformable in an axial sense, the bottom of which communicates with the interior of the intake duct and the edge of which is pressed into resilient engagement with the inner surface of the wall of the casing around the outlet orifice.

By virtue of this solution, the compressor draws the gas directly from the intake pipe through the suction cup. Compared to the prior art, this leads to the intake of gas at a lower temperature and thus to a greater mass flow rate, which results in more efficient refrigeration and greater efficiency of the compressor.

A liquid fraction is normally present in the refrigerant fluid drawn in by the compressor, which is constituted by some of the fluid in the liquid state and by lubricating oil entrained by the fluid during its compression. The suction cup acts a drain valve for this liquid fraction: by virtue of its flexibility, the suction cup deforms resiliently under the impact of the liquid drawn in, if this is excessive. The deformation detaches the edge of the suction cup from the wall of the casing and allows the liquid to drain to the bottom of the casing, as happens beneficially with known indirect intake systems. The return of the liquid to the bottom of the casing in fact avoids the depletion of the supply of oil with the possibility of mechanical failure, and the loss of efficiency of the refrigerating circuit due to the presence of an excessive quantity of oil in the fluid.

As in indirect intake systems, the refrigerant fluid drained into the casing in the liquid state returns to the circuit together with the oil.

Preferably, the connector duct includes or consists of a separator chamber having a lower bowl-shaped part the bottom of which communicates with the interior of the casing through one or more restricted passages for the continuous draining of the liquid fraction of the fluid.

This solution is still more advantageous both with regard to good lubrication of the motor-compressor and to the efficiency of the refrigeration circuit, since it allows constant draining of the oil. Thus, the frequency of formation of the inevitable accumulations of liquid in the fluid drawn in is reduced, with less fatigue of the suction cup since it does not have to undergo the sharp deformations necessary to drain the accumulations of liquid so often.

To advantage, the separator chamber has internal partitions which define a labyrinthine path for the gas, for silencing purposes.

Thus, the chamber is also used as an intake silencer for the compressor. In order to achieve this effect, the interior of the chamber may be arranged so as to form several resonance chambers in the labyrinthine passage, tuned so as to give the maximum noise reduction at the most intense and most irritating frequencies according to current noise-abatement criteria.

To advantage, the unit employs a casing which is formed, as in the prior art, by upper and lower half-shells joined in a horizontal plane and in which the motor-compressor rests on the bottom of the lower half-shell by means of a suspension spring, it being lowered into position in the lower half-shell before the fitting of the upper half-shell, the intake pipe opening into a wall of the lower half-shell.

In this case the suction cup is, to advantage, located so as to press resiliently into engagement with the inner surface of the lower half-shell of the casing as a result of the lowering of the motor-compressor into position.

This solution allows the motor-compressor to be assembled quickly in the casing by the usual method, without the need for auxiliary operations for connecting the intake pipe by means of the suction cup.

Figure 2:
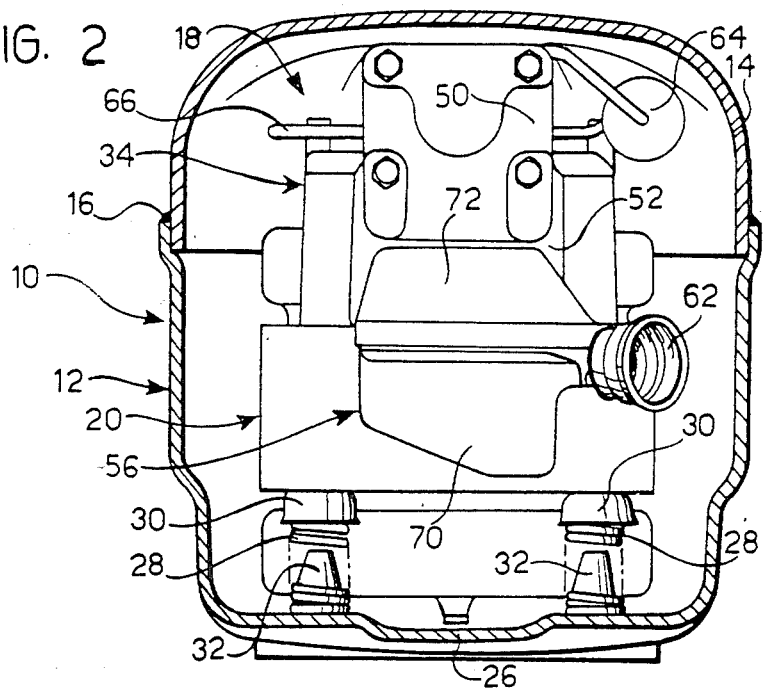
Figure 3:
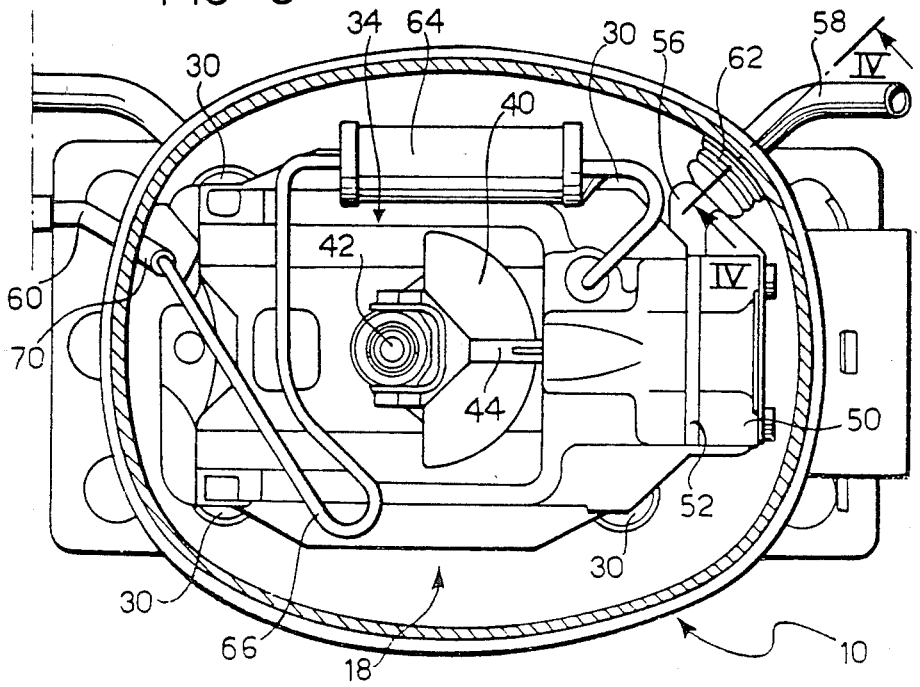
Figure 4:
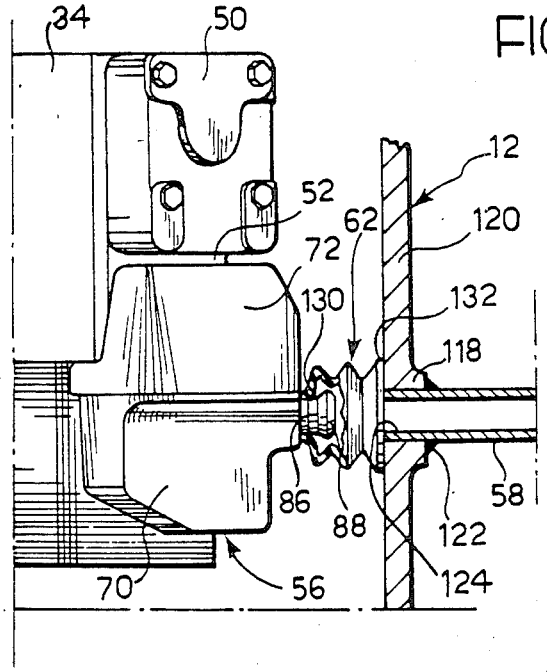
Figure 5:
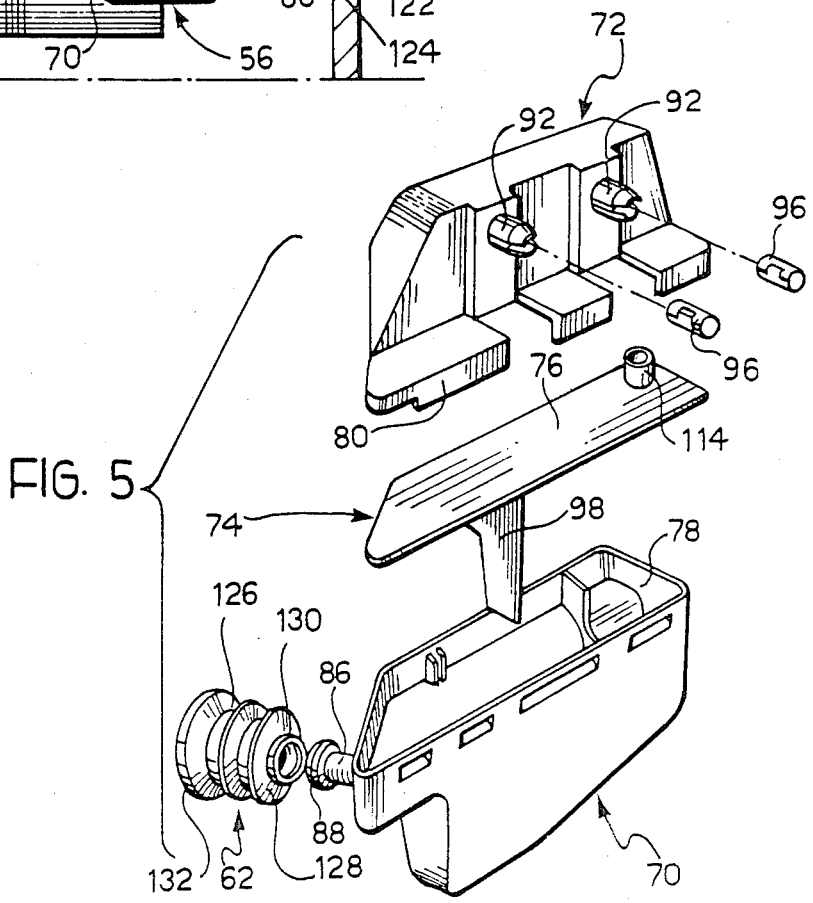

The invention will be better understood from a reading of the following detailed description of a preferred embodiment, given by way of non-limiting example and illustrated in the appended drawings, in which:

FIG. 1 is a sectional elevational view of a motor-compressor unit,

FIG. 2 is a vertical section taken substantially on the line II—II of FIG. 1, FIG. 3 is a horizontal section taken substantially on the line III—III of FIG. 1, FIG. 4 is a partial section taken on the line IV—IV of FIG. 3, on an enlarged scale, FIG. 5 is an exploded perspective view of the elements which make up the intake separator-silencer chamber, as well as the suction cup which connects this chamber to the intake pipe, FIG. 6 is a sectioned elevational view of the chamber and the suction cup, and FIGS. 7 and 8 are cross-sections taken on the lines VII—VII and VIII—VIII respectively of FIG. 6.

Referring to FIGS. 1 to 3, a motor-compressor unit includes a hermetic casing, generally indicated 10. The casing 10 is formed by a lower half-shell 12 and an upper half-shell 14 of strong drawn sheet metal. The two half-shells 12, 14 are joined in a horizontal plane and fixed together hermetically by means of a peripheral weld bead 16.

The casing 10 houses a motor-compressor, generally indicated 18. The motor-compressor 18 includes an electric motor 20 with a stator 22 and a rotor 24.

The stator 22 rests on the base wall 26 of the lower half-shell 12 with the interposition of vertical-axis helical suspension springs 28. The upper ends of the springs are held in cups 30 fixed to the stator 22, while their lower ends are located against lateral movement by respective pins 32 fixed to the base wall 26.

To the upper part of the stator 22 is fixed the body, generally indicated 34, of a volumetric piston compressor. A vertical tubular crankshaft 36 is rotatably supported in the body 34 and at its lower end has a conical mouth 38 acting as a pump for drawing oil from the sump constituted by the bottom of the casing 10.

At its upper end, the shaft 36 has an eccentric 40 and a crank-pin 42. The big end of a connecting rod 44 is articulated to the crank-pin 42, while its small end is articulated to a horizontal pin 46. The latter is slidable in a cylinder 48 formed in the body 34 and closed by a lateral head 50. A valve plate 52 is interposed between the body 34 and the head 50. The plate 52 also constitutes a closure wall of an intake manifold 54 of the compressor.

The manifold 54 has an associated box-shaped body 56 which, as will be seen below, constitutes separator-silencer means. The body 56 is fixed to the valve plate 52 in correspondence with the manifold 54, in the manner which will be described below.

Two pipes, an intake pipe 58 and a delivery pipe 60 respectively, terminate at the outside of the peripheral wall of the lower half-shell 12.

The intake pipe 58 communicates with the interior of the body 56 through a suction cup 62 of which more will be said below.

The delivery pipe 60 communicates with the delivery of the compressor through a discharge silencer 64 and a deformable tube 66.

The entire motor-compressor 18 is mounted in the casing 10 by a known method consisting of lowering it into the lower half-shell 12, before the upper half-shell 14 has been fitted, until it rests on the springs 28 around the pins 32. Once the motor-compressor has been located in this manner, the tube 66 is connected to an internal appendage 68 of the delivery pipe 60 and the upper half-shell 14 is then fitted and welded to the lower one 12.

Referring now to FIGS. 2 and 4 to 8, the body 56 is to advantage formed in three pieces from plastics material. A first piece is a bowl-shaped lower half-housing 70 shaped in the manner illustrated in the drawings. A second piece is an upper half-housing 72 shaped as in the drawings. A third piece, indicated 74, comprises in the main a horizontal dividing wall 76.

The two half-housings 70 and 72 have respective peripheral edges 78 and 80 which are snap-engaged in the manner illustrated. The dividing wall 76 is clamped between the two half-housings 70 and 72 as shown.

As can be seen particularly in FIG. 6, the dividing wall 76 divides the interior of the body 56 into a lower space 82 defined by the lower half-housing 70 and an upper space 84 defined by the upper half-housing 72.

At one end, the lower half-housing 70 has a tubular spigot 86 with a terminal collar or enlargement 88; this spigot 86, the aperture of which opens into the top part of the lower space 82, constitutes an inlet aperture of the body 56.

The upper half-housing 72 has, among other things, a side wall 90 for application to an outer flat surface corresponding to the lower part of the valve plate 52. A pair of tubular pins 92, aligned and spaced horizontally, project outwardly from the wall 90. The pins 92 are split longitudinally so that each is formed by a pair of arcuate resilient arms.

The valve plate 52 (FIG. 1) has a pair of through-holes 94 which open into the intake manifold 54.

In each tubular pin 92 is inserted a respective expansion spring 96 (FIG. 5) constituted by a resilient metal strip wound helically into a sleeve.

The tubular pins 92 are each engaged in a corresponding hole 94 in the valve plate 52 and serve both to fix the body 70 firmly to the valve plate 52, and hence to the body 34 of the compressor, and to establish communication between the upper space of the body 56 and the interior of the manifold 54 through the intake opening constituted by the two holes 94 in the plate 52.

A transverse partition 98 is formed integrally with the horizontal dividing wall 76 and extends into the lower space 82 without reaching the bottom. The lower half-housing 70 is formed integrally with an internal transverse partition 100 which extends upwardly to a certain distance from the dividing wall 76. Thus, the two partitions 98 and 100, together with the walls of the lower half-housing 70 and the dividing wall 76, define a labyrinthine path which comprises three successive chambers 102, 104 and 106 interconnected respectively by a lower passage 108 and an upper passage 110. The final chamber 106 of the lower space 82 communicates with the upper space 84 through an open passage 112 defined by a tubular part 114 formed integrally with the dividing wall 76.

The bottoms of the two chambers 102, 106 have respective restricted drainage passages or holes 116 and 118 which put the chambers 102 and 106 into communication with the interior of the casing 10.

Referring in particular to FIG. 4, the intake pipe 58 is inserted in a tubular boss 118 on a side part 120 of the wall of the lower half-shell 12. The tube 58 is welded at 122 to the boss 118 and extends through the wall part 120, but does not project from the inner surface of this wall, so as to present an orifice 124 flush with the inner surface.

With the body 56 fixed to the body 34 of the compressor, and with the motor-compressor 18 installed in position in the casing 10 as in FIG. 1, the arrangement is such that the aperture 86 is aligned with the orifice 124 and faces it as in FIG. 4.

Referring to FIGS. 4, 5 and 6, the suction cup 62 is constituted by a generally cup-shaped element of rubber or similar material. Its peripheral wall 126 is bellows-like to give the suction cup good axially resilient deformability. A tubular boss 130 is formed on the bottom 128 of the suction cup 62. The annular edge 132 of the suction cup is constituted by an enlarged lip.

The suction cup 62 is retained on the body 56 by virtue of the fact that the boss 130 is fitted tightly onto the tubular spigot 86 and the enlargement 88 engages the inner surface of the bottom 128 to hold the latter against the body 56.

The suction cup 62 is fitted before the motor-compressor 18 is lowered into the lower half-shell 12 of the casing 10.

As can be seen in FIGS. 1 and 4, the side wall part 120 of the lower half-shell 12 is flared or diverges upwardly. When the motor-compressor 18 is lowered into position in the lower half-shell 12, the edge 132 engages the flared wall part 120 which thus constitutes, so to speak, a lead-in to the correct positioning of the suction cup.

When the motor-compressor 18 reaches the position of FIG. 1, by virtue of the alignment of the spigot 86 with the orifice 124, the edge 132 of the suction cup 62 is disposed around the orifice 124. The dimensions are such that, under these conditions, the suction cup 62 is compressed resiliently in the axial sense, especially by virtue of the resilience of its bellows wall 126, and the edge 132 pressed resiliently against the inner surface of the wall part 120. Thus, a substantially gas-tight continuity is formed between the intake pipe 58 and the intake manifold 54 through the connector duct constituted essentially by the box-shaped body 56.

The behaviour of the box-shaped body 56 and its suction cup 62 during operation of the compressor will now be described briefly.

In the first place, the effect of the low pressure within the box-shaped body 56 and the suction cup 62 is added to the effect of the resilient axial compression of the suction cup itself, increasing the force with which the edge 132 is pressed against the wall 120, entirely to the advantage of the gas-tight sealing.

The arrangement is such that the edge 132 cannot become detached from the wall 120 as a result of oscillations of the motor-compressor 18 on the springs 28, which move the body 56 towards and away from the wall 120.

The refrigerant fluid is thus drawn from the pipe 58 by the compressor, through the body 56.

The presence of the labyrinthine path in the lower part of the body 56 has the primary effect of separating the liquid fraction (liquified refrigerant fluid and oil) from the fluid. This liquid fraction collects in the bottom of the two traps constituted one by the bottom of the two chambers 102, 104 and the other by the bottom of the chamber 106. The liquid thus collected drops continuously to the bottom of the casing 10 through the drainage passages 116 and 118. These passages 116 and 118 are restricted so as always to keep a certain quantity of liquid in the bottom of the traps, thereby avoiding any substantial intake of gas into the body 56 from the internal atmosphere of the casing 10.

Thus, essentially only the gaseous fraction of the refrigerant fluid reaches the upper space 84 in the body 56 and is then drawn through the manifold 54 by the compressor.

By virtue of the behaviour described below, the body 56 acts as a separator chamber.

The presence of the labyrinthine path also gives the body 56 the function of an intake silencing chamber. In order to make the maximum use of this effect, the dimensions and shape of the chambers 102, 104, 106 and 84, and their intercommunicating passages 108, 110 and 112, are so arranged that these chambers constitute resonance chambers tuned to give the maximum noise reduction at the most intense and most irritating frequencies according to current noise-abatement criteria.

As already stated in the initial part of the description, the suction cup 62 acts as a drainage valve when streams of liquid come from the intake pipe 58, as occurs for example upon starting of the compressor. Should the stream of liquid be persistent, the suction cup 62 deforms under the impact of the inducted liquid until its edge 132 becomes detached from the wall 120, thus allowing the liquid to drain to the bottom of the casing 10. In the case of small streams of liquid, the suction cup 62 is designed so as not to deform and cause its detachment, the liquid collecting in the traps in the body 56 and escaping through the drainage passages 116 and 118. Thus, excessive fatigue of the suction cup 62 as a result of the sudden deformation it undergoes when it behaves as a drainage valve are avoided.

I claim:

1. Hermetic motor-compressor unit for refrigeration circuits and the like, of the type in which a sealed casing (10) is formed by upper and lower half-shells joined in a horizontal plane and encloses a volumetric motor-compressor (18) for the refrigerant fluid in which the motor-compressor rests on the bottom of the lower half-shell by means of suspension springs, and in which a pair of pipes terminate at the outside of the casing, one of which is a fluid intake pipe (58) opening into the casing (10) through a wall (120) of the lower half-shell and communicating with an intake opening (94) of the motor-compressor, characterized in that the outlet of the intake pipe (58) into the lower half-shell is an orifice (124) in the wall (120) of the lower half-shell, and the intake opening (94) of the motor-compressor (1) is provided with a connector duct (56) which has an inlet aperture (86) facing the outlet orifice (124) of the intake pipe (58) and which carries a suction cup (62) having a peripheral bellows-like skirt that is resiliently deformable in an axial sense, the bottom (128) of which communicates with the interior of the intake duct (56) and the edge (132) of which is pressed into resilient engagement with the inner surface of the wall (120) of the lower half-shell around the outlet orifice (124) whereby the bellows-like suction cup may be resiliently deformed in an axial sense under impact of inducted liquid to allow the liquid to drain into the lower half-shell.

* * * * *

UNITED STATES PATENT AND TRADEMARK OFFICE

CERTIFICATE OF CORRECTION

PATENT NO. : 4,793,775

DATED : December 27, 1988

INVENTOR(S) : Federigo Peruzzi

It is certified that error appears in the above-identified patent and that said Letters Patent is hereby corrected as shown below:

On the title page priority data should read

--(30) Oct. 31, 1984 (IT) Italy 68088 A/84--

Signed and Sealed this

Twenty-ninth Day of August, 1989

*Attest:*

DONALD J. QUIGG

*Attesting Officer*

*Commissioner of Patents and Trademarks*